United States Patent [19]

Hagerty

[11] Patent Number: 4,881,648

[45] Date of Patent: Nov. 21, 1989

[54] CONTAINER FOR TABLETS, PILLS OR THE LIKE

[76] Inventor: Robert F. Hagerty, 159 Rutledge Ave., Charleston, S.C. 29403

[21] Appl. No.: 244,989

[22] Filed: Sep. 15, 1988

[51] Int. Cl.[4] ..... B65D 83/04

[52] U.S. Cl. ..... 206/540; 215/1 C

[58] Field of Search ..... 206/540, 535, 528; 215/1 C, 1 R

[56] References Cited

U.S. PATENT DOCUMENTS

| | | | |
|---|---|---|---|
| D. 86,712 | 4/1932 | Fuerst . | |
| D. 190,056 | 4/1961 | Diamond . | |
| D. 195,896 | 8/1963 | Garvey . | |
| D. 277,363 | 1/1985 | Drummond, Jr. et al. . | |
| D. 282,636 | 2/1986 | Beaver et al. . | |
| 844,579 | 2/1907 | Clements | 215/1 R |
| 2,885,124 | 5/1959 | Green et al. . | |
| 2,976,988 | 3/1961 | Schneider . | |
| 3,362,530 | 1/1968 | Johnson . | |
| 3,449,210 | 6/1969 | Rohde | 215/1 C |
| 3,638,830 | 2/1972 | Belokin, Jr. . | |
| 3,698,543 | 10/1972 | Trotta . | |
| 3,954,179 | 5/1976 | Warmath . | |
| 3,964,609 | 6/1976 | Perrella . | |
| 4,227,615 | 10/1980 | Flick | 206/540 X |
| 4,262,802 | 4/1981 | Laauwe . | |
| 4,412,625 | 11/1983 | Zander . | |
| 4,420,076 | 12/1983 | Beveridge et al. . | |
| 4,522,313 | 6/1985 | Jennings et al. . | |

FOREIGN PATENT DOCUMENTS

| | | | |
|---|---|---|---|
| 149490 | 5/1937 | Austria . | |
| 2318473 | 10/1974 | Fed. Rep. of Germany . | |
| 1127298 | 8/1956 | France | 206/540 |
| 175993 | 7/1961 | Sweden . | |
| 932823 | 7/1963 | United Kingdom | 215/1 R |

*Primary Examiner*—William Price

*Attorney, Agent, or Firm*—Bell, Seltzer, Park & Gibson

[57] ABSTRACT

The invention is directed to a container for tablets, pills or the like having means to permit easy dispensing of tablets, pills or the like without requiring a high degree of manual dexterity. The container comprises an integral body having a bottom wall and a circumferential side wall forming an enclosure. At the top of the enclosure is a cylindrical neck with a cylindrical opening therein. Below the neck and along a portion of the circumferential side wall is a bulbous portion. The container further has a smooth continuous inner wall surface extending along the bulbous portion and through to the cylindrical opening without any abutments. The container is therefore able to permit a person to reach into the enclosure with a finger, and slide a pill along the smooth inner wall out through the opening.

7 Claims, 1 Drawing Sheet

CONTAINER FOR TABLETS, PILLS OR THE LIKE

FIELD OF THE INVENTION

This invention relates to container for tablets, pills or the like and more particularly to containers for easily dispensing pills by sliding a pill along a smooth inner wall out through the opening.

BACKGROUND OF THE INVENTION

Conventional pill bottles are generally made of plastic and have a hollow body with a neck at the top thereof. A shoulder is generally formed at the juncture of the neck and body which forms a ridge inside the bottle that can make it very difficult to remove a single pill from the bottle. For example, when the bottle is slowly tilted, the pills get hung up on the ridge until all of a sudden there is a rush of pills. The ridge also interferes with inserting a finger into the bottle and drawing a single pill along the surface because the pill is caught by the ridge which will not allow it to slide out.

Dispensing a pill from a container should be a quick and simple process. However, for those persons afflicted with arthritis or some other debility, removing a single pill from a bottle is a recurring ordeal. These people do not necessarily have the manual dexterity to shake the bottle just right to cause a single pill or the desired number of pills to fall out into the palm of their hand. This is a particular problem because people who have these afflictions are generally prescribed more medications than an average person.

Some prior art devices show pill bottles with mechanical dispensers such as U.S. Pat. No. 3,638,830 to Belokin and U.S. Pat. No. 4,522,313 to Jennings et al. Belokin shows a container with a two piece rotating top that dispenses medication one unit at a time. Jennings et al. shows a container having a rotating spherical dispensing element with a recess at the top thereof to dispense pills out of the container. These prior art devices require a certain precision in manufacturing to operate properly which tends to make the devices somewhat expensive. Also, the devices can only effectively dispense a limited range of pill sizes.

U.S. Pat. Nos. 190,056 and 277,363 to Diamond and Drummond et al., respectively, show container designs with bulging side walls, and which have shoulder portions which form ridges near the neck of the container. It does not appear that these containers relate to containers for pills, and in any event the ridge, as discussed above, would interfere with easy dispensing of pills.

U.S. Pat. No. 3,362,530 to Johnson shows a receptacle and dispenser comprising a bottle with sleeve portions therein holding tablets in a coin stack to prevent the tablets from striking one another and breaking. Johnson suffers the drawback that the sleeve portions tend to add expense to the container. It is also noted that the sleeve portions have to be appropriately sized for the tablets, therefore, Johnson can only handle a limited size of tablets.

U.S. Pat. Nos. 3,964,609 and 4,262,802 to Perrella and Laauwe, respectively, disclose dispensing containers that have a lid member and a closure for the lid member. In each of Perrella and Laauwe the lid member effectively provides a ridge or lip that would interfere with the easy dispensing of a pill.

Accordingly, it is an object of the present invention to provide a pill bottle for easily dispensing one or more pills and which avoids the disadvantages of the prior art bottles as noted above.

It is a more particular object of the present invention to provide a simple and inexpensive pill bottle for easily dispensing one or more pills of all sizes by reaching into the container with a finger and easily slidably withdrawing one or more pills out along an inside wall.

SUMMARY OF THE INVENTION

The above and other objects of the invention have been achieved in the present invention by the provision of a container comprising an integral body which includes a generally horizontal bottom wall having an outer periphery and a circumferential side wall extending upwardly from said outer periphery of said bottom wall thereby defining an enclosure. A generally cylindrical relatively short neck is positioned at the top upper extremity of the side wall and defines a generally cylindrical opening which is sized to receive a human finger therethrough so that the finger is able to reach downwardly a substantial distance within the enclosure. The side wall includes a bulbous portion extending downwardly and laterally outwardly from the neck. The bulbous portion and the neck define a continuous inner wall surface of the integral body which extends along the length of the bulbous portion and through said neck opening with said continuous inner wall surface being smooth along its length so as to permit a single tablet, pill, or the like to be isolated on the inner wall surface by a finger extending through said opening and then withdrawing along the inner wall surface and outwardly through said opening without engaging any abutment or ridge.

BRIEF DESCRIPTION OF THE DRAWINGS

Some of the features and advantages of the invention having been stated, others will become apparent as the description proceeds, and taken in conjunction with the accompanying drawings, in which.

DETAILED DESCRIPTION OF THE PREFERRED EMBODIMENTS

Figure 1:
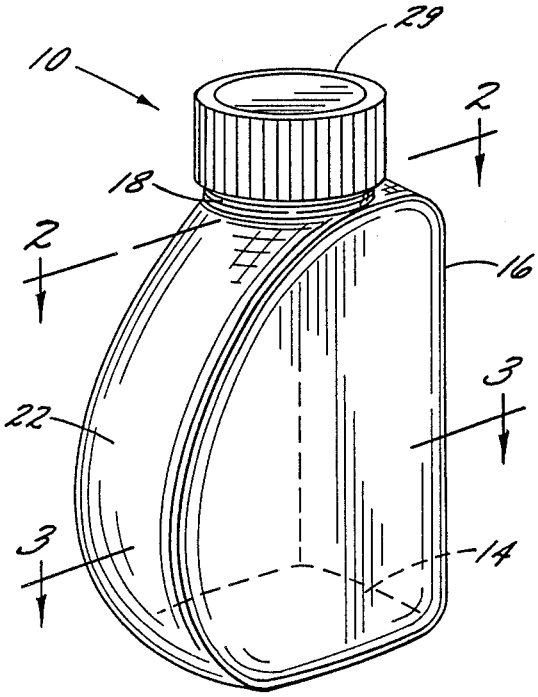
FIG. 1 is a perspective view of a pill container embodying the features of the present invention.
Figure 2:
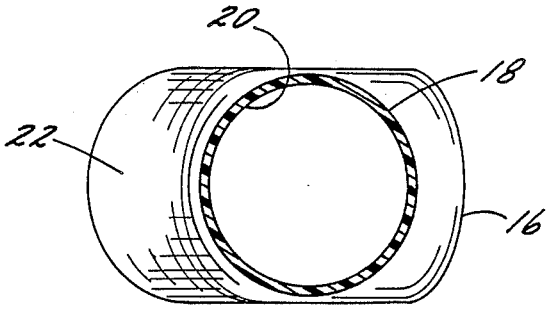
FIG. 2 is a cross sectional view of the pill container taken along line 2—2 in FIG. 1.
Figure 3:
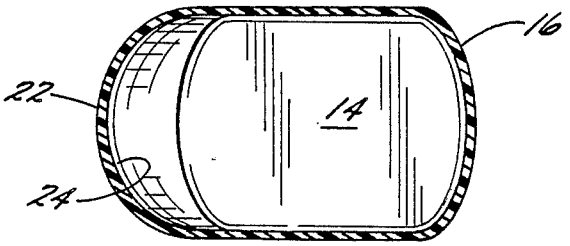
FIG. 3 is a cross sectional view of the pill container taken along line 3—3 in FIG. 1.

Referring more particularly to the drawings, FIGS. 1–3 illustrate a container for supporting tablets, pills or the like generally indicated by the numeral 10 which embodies the features of the present invention. The container 10 comprises an integral body 12 which includes a generally horizontal bottom wall 14 and a circumferential side wall 16 which is integrally attached to the outer periphery of the horizontal bottom wall and extends upwardly therefrom. The generally horizontal bottom wall 14 and the circumferential side wall 16 form and define an enclosure for receiving and supporting the tablets, pills or the like. At the upper extremity of the circumferential side wall 16 is a relatively short cylindrical neck 18 defining a generally cylindrical neck opening 20 serving as the opening for the container.

The side wall of the body 12 includes a bulbous portion 22 which extends downwardly and laterally outwardly from the generally cylindrical opening 20 of the bottom wall 14.The bulbous portion is continuously curved from said neck opening 20 to said horizontal bottom wall 14. Thus the inner surface of the bulbous portion 22 and the inner surface of the neck 18 through opening 20 collectively define a continuous inner wall surface 24 which is smooth and continuous along the length of the bulbous portion 22 and the neck opening 20, as well as through the transition between the bulbous portion and the neck 18. Thus, this transition area has no abutment, ridge, or other obstruction which would interfere with the sliding removal of a pill as further described below.

Figure 4:
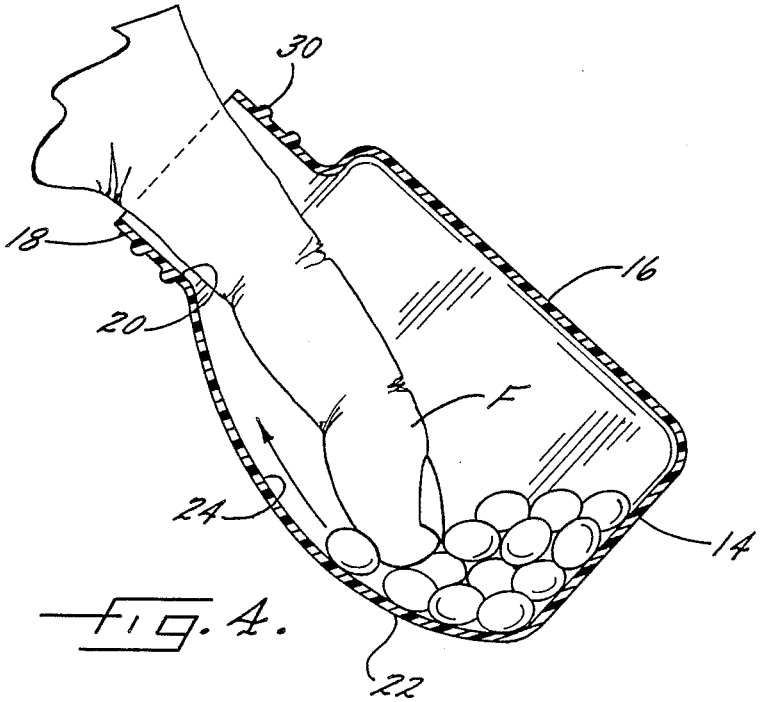
FIG. 4 is a cross sectional view of the pill container particularly illustrating the removal of a pill from the container by grasping a pill with a finger and sliding it along the inside surface outwardly through the neck opening.

The unique form of the container 10 provides a simple and easy manner of removing pills therefrom. This is particularly beneficial for persons not having a high degree of manual dexterity because of disease or old age. In particular, as best seen in FIG. 4, the cylindrical opening is sized to receive a human finger F with sufficient room for one or more tablets or pills to accompany the finger F when slidably removing the pills from the container. The container 10 is also desirably sized so that a human finger F may also reach downwardly a substantial distance within the enclosure so that the pills in lower regions of the container can be reached.

The bulbous portion 22 provides a shallow well or recess for receiving the tablets or pills when the container is tipped in the manner illustrated in FIG. 4 which may be 10 to 90 degrees, but is preferably 15 to 45 degrees. As such, the tablet or pills are all localized so that a single one may be easily selected for removal. The bulbous portion 22 also conforms with and accommodates the natural bend of the finger F so that a tablet or pill may be easily "hooked" or grasped. Once a tablet or pill has been "hooked" against the inner wall surface 24, the finger may slide it all the way out without interference by an abutment or ridge.

The container 10 is further provided with means at the outer portion of the neck for securely receiving the closure member a cap 29 for sealingly closing the cylindrical opening. This securing means for securely receiving the closure member may be any conventional means such as screw threads 30 or a snap fit ridge. As shown the closure member 29 is relatively short and has a length of about the same as the length of said neck, and only a small fraction of the length of one's finger.

It is, however, recommended that the means allow for easy opening, to be in keeping with the objectives of the invention, to provide a container for use by persons not having a high degree of manual dexterity.

The container, it should be noted, except for the unique structural and functional features discussed above, may be considered a conventional pill bottle by the consuming public. The bottom wall 14 is preferably a rectangular shape when considered in plan view and the circumferential side wall 16, except for the portion that includes the bulbous portion, is composed of three substantially flat sides which extend substantially vertically between the bottom wall 14 and the neck 18. The resulting flat parallel opposite sides facilitate the manual grasping of the container by the user. Also, the container may be readily fabricated from plastic or glass using conventional molding techniques.

In a particular alternative embodiment envisioned within the scope of this invention is a pill container with bulbous portions at opposite sides of the container. Such a bilateral container would be symmetrical in appearance and more readily oriented for dispensing pills.

In the drawings and specification there has been set forth preferred embodiments of the invention, and although specific terms are employed, they are used in a generic and descriptive sense only and not for purposes of limitation.

That which I claim:

1. A container adapted for containing a plurality of tablets, pills, or the like, and characterized by the ability to permit the tablets, pills, or the like to be readily and individually grasped by one's finger and slidably removed from the container without requiring a high degree of manual dexterity, and comprising an integral body which includes a generally horizontal bottom wall having an outer periphery;

a circumferential side wall extending upwardly from said outer periphery of said bottom wall so as to define an enclosure;

a generally cylindrical neck positioned at the upper extremity of said side wall and defining a generally cylindrical opening which is sized to receive one's finger therethrough and so that the finger is able to flex and reach downwardly a substantial distance within said enclosure, said neck being relatively short and having a length of only a small fraction of the length of one's finger so that one's finger may extend beyond the neck within the confines of the container;

means on said neck for receiving a closure member for sealingly closing the container;

a closure member cooperating with said means on said neck for sealingly closing the container, and wherein said closure member is relatively short and has a length of about the same as said neck; and wherein said side wall includes a bulbous portion extending downwardly from said neck and laterally outwardly from said opening of said neck and being continuously curved to said horizontal bottom wall, and with said bulbous portion and said neck defining a continuous inner wall surface which extends along the length of said bulbous portion and through said neck opening, and with said continuous inner wall surface being smooth along its entire length so as to permit a single tablet, pill, or the like to be grasped and isolated on said inner wall surface in said bulbous portion by one's finger extending through said opening and then slidably withdrawn by one's finger along said inner wall surface and outwardly through said neck opening without engaging any abutment.

2. The container as defined in claim 1 wherein said side wall includes a remaining portion which extends substantially vertically between said bottom wall and said neck.

3. The container as defined in claim 2 wherein said bottom wall is substantially rectangular in plan view, and said bulbous portion extends upwardly from one side of said rectangular bottom wall, and said remaining portion extends upwardly from the remaining sides of said rectangular bottom wall.

4. The container as defined in claim 3 wherein said remaining portion includes three generally flat sides, with the two sides which are located on respective opposite sides of said bulbous portion being generally parallel to each other.

5. A container according to claim 1 including the combination therewith of a plurality of tablets, pills or the like.

6. A container adapted for containing a plurality of tablets, pills, or the like, and characterized by the ability to permit the tablets, pills, or the like to be readily and individually grasped by one's finger and slidably removed from the container without requiring a high degree of manual dexterity, said container comprising an integral body which includes a generally horizontal bottom wall;

side walls extending from said bottom wall so as to define an enclosure with the bottom wall;

a generally cylindrical neck connected to said side walls and defining a generally cylindrical opening which is sized to readily receive one's finger therethrough and so that the finger is able to flex and reach downwardly a substantial distance within said enclosure, said neck being relatively short and having a length of only a small fraction of the length of one's finger so that the major extent of one's finger may extend beyond the neck within the confines of the container;

means on said neck for receiving a closure member for sealingly closing the container;

a closure member cooperating with said means on said neck for sealingly closing the container, and wherein said closure member is relatively short and has a length of about the same as said neck; and wherein said side walls include a bulbous portion extending downwardly away from said neck and laterally outwardly from said neck and being continuously curved to said horizontal bottom wall so as to define a shallow well for reception of tablets or pills to be dispensed, and with said bulbous portion and said neck defining a continuous inner wall surface which extends along the length of said bulbous portion and through said neck opening, and with said continuous inner wall surface being smooth along its entire length so as to permit a single tablet, pill, or the like to be isolated by grasping with one's finger in said shallow well defined by said bulbous portion and then slidably withdrawn by one's finger along said inner wall surface and outwardly through said neck opening without engaging any abutment.

7. The combination of a container and a plurality of tablets, pills, or the like disposed within said container, said container being characterized by the ability to permit said tablets, pills, or the like to be readily and individually grasped by one's finger and slidably removed from the container without requiring a high degree of manual dexterity, said container comprising an integral body which includes a generally horizontal bottom wall;

side walls extending from said bottom wall so as to define an enclosure with the bottom wall;

a generally cylindrical neck connected to said side walls and defining a generally cylindrical opening which is sized to readily permit said tablets, pills, or the like to pass therethrough and to receive one's finger therethrough and so that the finger when positioned in said container is able to flex and reach downwardly a substantial distance, said neck being relatively short and having a length of only a small fraction of the length of one's finger so that the major extent of one's finger may extend beyond the neck within the confines of the container;

means on said neck for receiving a closure member for sealingly closing the container;

a closure member cooperating with said means on said neck for sealingly closing the container, and wherein said closure member is relatively short and has a length of about the same as said neck; and wherein said side walls include a bulbous portion extending downwardly away from said neck and laterally outwardly from said neck and being continuously curved to said horizontal bottom wall so as to define a shallow well for reception of said tablets or pills to be dispensed, and with said bulbous portion and said neck defining a continuous inner wall surface which extends along the length of said bulbous portion and through said neck opening, and with said continuous inner wall surface being smooth along its entire length so as to permit a single one of said tablets, pills, or the like to be isolated by grasping with one's finger in said shallow well defined by said bulbous portion and then slidably withdrawn by one's finger along said inner wall surface and outwardly through said neck opening without engaging any abutment.

* * * * *